United States Patent [19]

Leunig

[11] Patent Number: 4,471,919

[45] Date of Patent: Sep. 18, 1984

[54] UTILITY REEL

[75] Inventor: Carl V. Leunig, Glenmont, N.Y.

[73] Assignee: Crellin, Inc., Chatham, N.Y.

[21] Appl. No.: 417,706

[22] Filed: Sep. 13, 1982

[51] Int. Cl.[3] ..... B65H 75/22; B65H 75/14

[52] U.S. Cl. ..... 242/115; 242/118.4

[58] Field of Search ..... 242/115, 116, 118.4, 242/118.61, 71.8, 71.9, 137; 206/403, 404, 405, 407, 414, 415, 416

[56] References Cited

U.S. PATENT DOCUMENTS

| | | | |
|---|---|---|---|
| 1,827,000 | 10/1931 | Duffin | 242/137 |
| 3,552,677 | 1/1971 | Hacker | 242/118.61 |
| 3,940,085 | 2/1976 | Campbell | 242/115 |

FOREIGN PATENT DOCUMENTS

| | | | |
|---|---|---|---|
| 1028424 | 4/1958 | Fed. Rep. of Germany | 242/118.4 |
| 2822213 | 11/1979 | Fed. Rep. of Germany | 242/118.61 |

*Primary Examiner*—Leonard D. Christian

*Attorney, Agent, or Firm*—Kane, Dalsimer, Kane, Sullivan & Kurucz

[57] ABSTRACT

An improved utility reel having a barrel formed of two segments and a flexible hinge connecting the inner walls of the two portions longitudinally and the outer walls in a snap fit manner. Locking rings at each end of the barrel formed from the respective segments and engageable with a camming surface on circular flanges thereby maintained on respective ends of the barrel.

10 Claims, 4 Drawing Figures

UTILITY REEL

FIELD OF THE INVENTION

The present invention relates to a reel or spool for wire and the like.

BACKGROUND OF THE INVENTION

There presently exist many forms of reels or spools for wire and the like some of which are fabricated as a single piece or as an assembly of multiple parts. Typical reels of this type comprise a cylindrical barrel having coupled at each end circular flanges. Coupling may be mechanical but usually involves the welding of the flange to the barrel for strength.

Reels are subject to wide applications and a variety of specification requirements. In this regard, certain reels are required to have a particular size barrel and flanges. Another reel may utilize the same size barrel but a different size flange or a flange made of a different type material, or vice versa. It is therefore desirable to provide for ready interchangeability of the elements of the reel as desired. This would obviously reduce the cost of production and allow for somewhat standardization of tooling.

Also it is desirous to provide a reel of the knock down type which is readily and effectively assembled preferably by hand so as to eliminate the need for prefabrication and assembly of the reel prior to shipping, thereby reduce the transportation costs involved.

SUMMARY OF THE INVENTION

Accordingly, it is an object of the invention to provide for a reel for wire and the like which is relatively inexpensive yet versatile, capable of modular fabrication and assembly so as to allow for the interchangeability of parts and yet avoid the necessity of preassembly prior to shipping.

The present invention provides for a modular assemblied spool or reel which is fabricated out of a reel barrel or core which is formed in two halfs integrally hinged together along a longitudinal line having a snap hinge or interlocking means along its opposite longitudinal side.

Each end of the barrel is open having a beveled full radial locking ring formed thereon adapted to engage a circular cam section provided on the respective flanges. The reel is assembled simply by placing the cam sections of each flange into a portion of the respective locking rings at each end of the barrel and closing over the barrel until the interlocking means engages. This tightly locks the flanges in place at the ends of the barrel. In addition, since wire or the like is to be wound about the barrel, this provides added radial pressure holding the barrel together.

Thus the real may be readily yet effectively assemblied without the requirement of tools, welding or extensive labor and may be done by hand. In addition, since the reel is assembled from modular parts, this allows for ready interchangeability i.e., the use of different size or material flanges on different size or material barrels as long as the locking ring and cam sections are compatible, providing versatility and reduced cost.

BRIEF DESCRIPTION OF THE DRAWINGS

These and other objects and advantages will be realized by the present invention, the description of which would be taken in conjunction with the following drawings wherein.

DETAILED DESCRIPTION OF THE PREFERRED EMBODIMENT

Figures 1, 2:
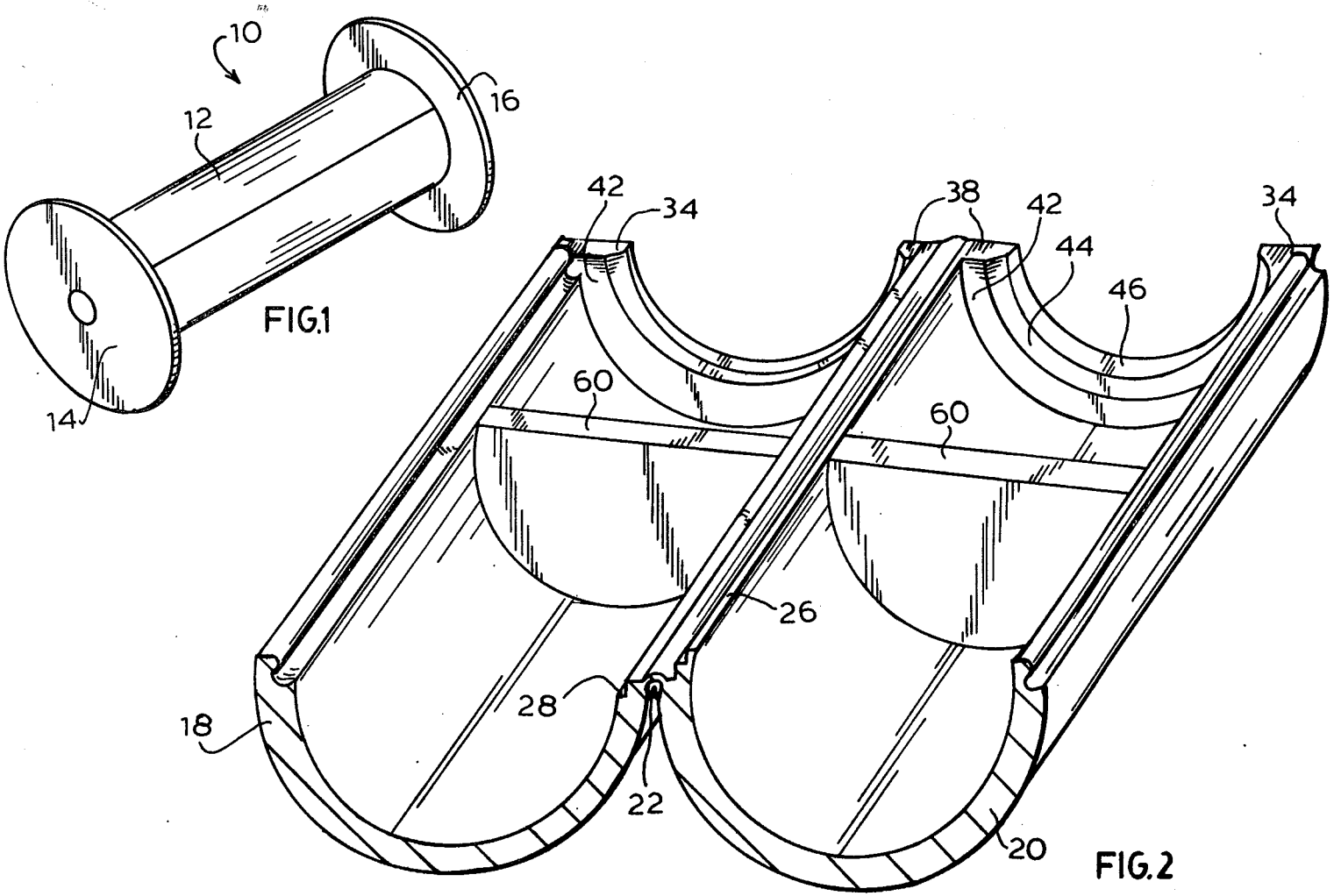
FIG. 1 is a perspective view of the reel or spool incorporating the teachings of the present invention.
FIG. 2 is a partially sectional view of the barrel portion of the reel shown in its open position incorporating the teachings of the present invention.

Turning now more particularly to the drawings, there is shown a reel or spool 10 comprising a cylindrical hollow barrel 12 with circular flanges 14 and 16 positioned at its respective ends. The barrel 12 is formed out of two semi-circular halves 18 and 20 and is preferably integrally hinged together along one of their respective longitudinal sides via hinge 22. Note that the hinge 22 is formed so that its outer surface 24 is flush with the outer surface of the core halves 18 and 20 so that when the barrel is closed, the hinge 22 is flush therewith giving it a clean, asthetic look.

The barrel halves 18 and 20 and hinge 22 may be made with a variety of material suitable for purpose however if integrally constructed, they should be made of a ductile polymer material which is somewhat flexible, i.e., resilient material such as preferably polypropylene or polypropylene-asbestos, for example.

Figure 3:
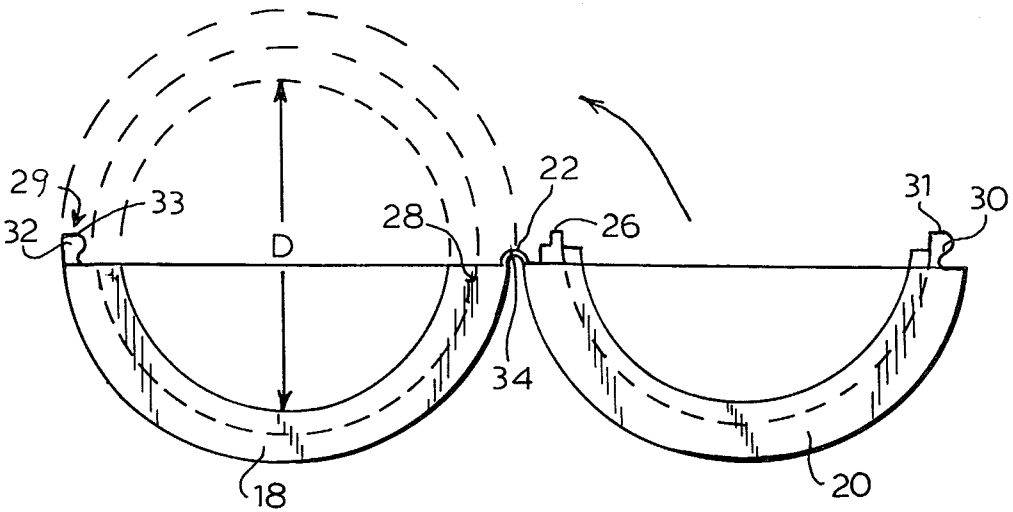
FIG. 3 is a vertical partially phantom view of the barrel shown going from its open to closed position.

Along hinge 22 and formed as part of barrel half 20 is provided a buttress or arm means 26 extending the length of half's 20 longitudinal length which is intended to engage in a mating like relationship with a notch 28 along the longitudinal length of half 18 when the barrel 12 is closed, as shown in phantom in FIG. 3.

The arm 26 in conjunction with notch 28 serves to stabilize the hinge 24 upon closing the barrel 12 so as to prevent any undesired lateral movement of the hinge 22 caused by a snap hinge or interlock means 29 and to retain the snap fit as hereinafter discussed. Note that if desired, the notch 28 in association with arm 26 may readily be provided with an appropriate undercut to reduce tensile loading of the hinge.

In this regard, the snap hinge 29 comprises two mating tongue and groove interlocks 30 and 32 formed on the longitudinal sides of the core halves 18 and 20 opposite to their coupling at hinge 22. The interlocks 30 and 32 provide for a flush joint at their junction due to the butt flats 31 and 33 provided. Upon closure of the barrel 12, the resiliency or flexible nature of the halves 18 and 20 allows the interlocks 30 and 32 to snap fit with each other with the respective tongue of each being spring biased in the respective groove of the other.

Figure 4:
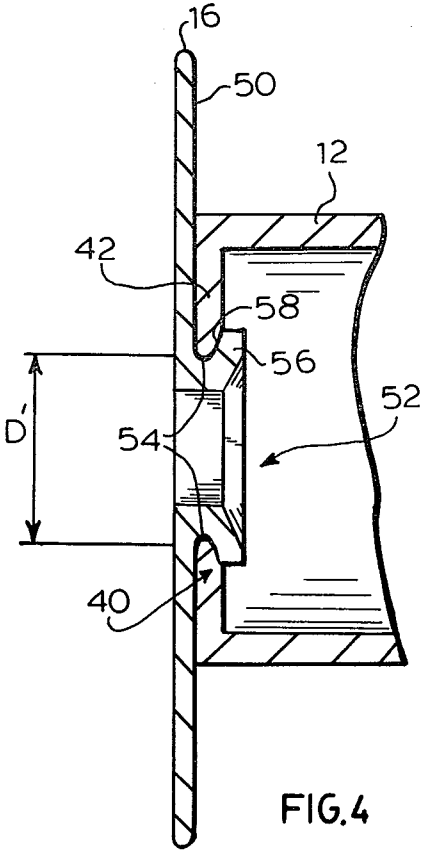
FIG. 4 is a partially sectional view of the barrel and flange coupled together incorporating the teachings of the present invention.

The interlocks 30 and 32 respectively terminate at a flat surface 34 of locking ring segments 36 positioned at each end of the core halves 18 and 20. These flat surfaces 34 as well as flat surfaces 38 abut the corresponding surface on the opposite core half to create a complete locking ring 40. The locking ring segments comprise radially protruding wall sections 42 of uniform cross section having a tapered portion 44 coupled thereto terminating in a flat annular surface 46. The outer surface 48 of the locking ring 40 is flat so as to smoothly abut the inner surface 50 of the respective flanges as shown in FIG. 4.

Note that the inner diameter D (see FIG. 3) of the locking ring 40 is of such a size that it receives an axially disposed annular camming element 52 on the respective flanges.

In this regard, camming element 52 includes a grooved surface 54 positioned between the inner surface 50 and cam lip 56. Note that the cam lip 56 includes a tapering surface 58 which may serve as a locking taper (i.e., for example if 6° or less) when abutting taper 46 of the locking ring 40 as shown in FIG. 4, both of which serve to tightly bias the flanges to the barrel 12. Also diameter D should correspond to (or may be slightly smaller than) diameter D′ so as to add to the effective coupling therebetween.

Note also that the barrels may be provided with radial ribbing 60 appropriately halved as shown to increase the load capacity of the barrel 12, if so desired.

As is readily apparent, assembly of the reel 10 may be easily accomplished by placing the camming member of the respective flanges into a locking ring segment at the barrel's end (when open) and closing the barrel halves into the snap fit arrangement as aforenoted. This not only allows for hand assembly but also allows for different size (i.e., length and/or diameter) or material barrels to be coupled with different size and material (i.e., higher modulus material, filled etc.) flanges as long as the diameters D and D′ operationally correspond, adding to the versatility of the product.

Thus by the present invention its objects and advantages are realized and although a preferred embodiment has been disclosed and described in detail herein, its scope should not be limited thereby, rather its scope should be determined by that of the appended claims.

What is claimed is:

1. A reel for wire and the like comprising:

hollow cylindrical barrel, said barrel comprising at least two semi-circular elongated segments which terminate in respective elongated sides, said segments including hinge means hingedly connecting together said segments along at least one respective elongated side, and interlock means detachably connecting the remaining respective elongated sides and spring biased to create a snap fit therebetween to form said barrel; and flanges respectively coupled to each end of the barrel, and maintained on said barrel by engagement with said segments.

2. The reel in accordance with claim 1 wherein said hinge means is integral with respective elongated sides of said segments.

3. The reel in accordance with claims 1 or 2, which includes locking rings disposed about the interior circumference of the barrel at the barrels respective ends and adapted to fixedly secure respective flanges to the barrel, said locking ring comprising two sections, each of which is integrally formed with respective barrel segments, and serve to form a complete locking ring when the segments are coupled together.

4. A reel for wire and the like comprising:

hollow cylindrical barrel, said barrel comprising at least two semi-circular elongated segments which terminate in respective elongated sides;

hinge means hingedly connecting said segments along at least one respective adjacent elongated side and being integrally formed therewith;

interlock means detachably connecting the remaining respective elongated sides of said barrel to create a snap fit therebetween;

said interlock means and said hinge means being positioned throughout substantially the entire length of said respective elongated sides; and flanges respectively coupled to each end of the barrel and maintained on said barrel by engagement with said segments.

5. The reel in accordance with claim 4 wherein said interlocking means comprises mating tongue and groove means disposed on respective elongated sides.

6. The reel in accordance with claim 5 which includes buttress means disposed adjacent said hinge on one of the respective elongated sides coupled to the hinge and notch means to receive said buttress means on the other elongated side coupled to the hinge with said buttress and notch means capable of preventing lateral shifting of the segments.

7. The reel in accordance with any one of claims 4–6 which includes locking rings disposed about the interior circumference of the barrel at the barrels respective ends and adapted to fixedly secure respective flanges to the barrel, said locking ring comprising two sections, each of which is integrally formed with respective barrel segments, and serve to form a complete locking ring when the segments are coupled together.

8. The reel in accordance with claim 7 wherein said locking ring comprises a radially inwardly protruding lip which defines an opening of a predetermined diameter at said barrels respective ends; said flanges comprising circular disc shape members and camming member axially disposed with respect to said flange, said camming member inwardly projecting into the barrel and having an outer diameter substantially equal to the predetermined diameter and engageable with respective locking ring sections to maintain the respective flanges on the barrel.

9. The reel in accordance with claim 8 wherein said lip included a tapered edge, said camming member includes an annular groove and tapered surface which said taper edge engages as the segments are coupled together.

10. A flange in combination with a cylindrical barrel formed from at least two elongated semi-circular segments to form a reel, said flange comprising:

a circular disc member;

a camming member axially disposed with respect to said disc member; and said camming member including means insertable into a barrel's interior via its open end, said means being circular having an annular groove thereabout which receives a portion of each segment in a camming engagement therewith when coupled together.

* * * * *